US010959909B2

(12) United States Patent
Li et al.

(10) Patent No.: US 10,959,909 B2
(45) Date of Patent: Mar. 30, 2021

(54) HEPATOCARCINOMA METASTASIS THERAPY APPARATUS AND METHOD FOR USING THE SAME

(71) Applicant: Fusheng Li, Shandong (CN)

(72) Inventors: Fusheng Li, Shandong (CN); An Li, Shandong (CN); Jing Du, Shandong (CN); Xiaomei Yang, Shandong (CN)

(73) Assignee: Fusheng Li, Shandong (CN)

( * ) Notice: Subject to any disclaimer, the term of this patent is extended or adjusted under 35 U.S.C. 154(b) by 656 days.

(21) Appl. No.: 15/517,907

(22) PCT Filed: Aug. 28, 2015

(86) PCT No.: PCT/CN2015/088330
§ 371 (c)(1),
(2) Date: Apr. 7, 2017

(87) PCT Pub. No.: WO2016/054954
PCT Pub. Date: Apr. 14, 2016

(65) Prior Publication Data

US 2017/0304142 A1 Oct. 26, 2017

(30) Foreign Application Priority Data

Oct. 8, 2014 (CN) ..... 201410524366.9

(51) Int. Cl.
*A61H 15/02* (2006.01)
*A61H 1/02* (2006.01)
(Continued)

(52) U.S. Cl.
CPC ..... *A61H 15/02* (2013.01); *A61H 1/02* (2013.01); *A61H 1/0214* (2013.01);
(Continued)

(58) Field of Classification Search
CPC ..... A61H 15/02; A61H 15/0085; A61H 2015/0007; A61H 1/02; A61H 1/0214;
(Continued)

(56) References Cited

U.S. PATENT DOCUMENTS 326,247 A * 9/1885 Root ..... A63B 22/0056 482/56
1,620,146 A * 3/1927 Walton ..... A63B 21/154 482/56

(Continued)

FOREIGN PATENT DOCUMENTS

CN 202822036 U 3/2013
CN 203494104 U 3/2014

(Continued)

OTHER PUBLICATIONS

International Search Report dated Nov. 24, 2015.

*Primary Examiner* — Bradley H Philips
*Assistant Examiner* — Savannah L Gabriel
(74) *Attorney, Agent, or Firm* — Cantor Colburn LLP

(57) ABSTRACT

A liver cancer metastasis therapeutic device, comprising: a base plate, a prone support, an abdomen massager, a medicated gauze, a sprocket bracket, a transmission shaft, a sprocket, a chain, rotary plates, pedals, a handwheel bracket, handwheels, and an adjustable speed motor. The prone support is fixedly installed on the middle of the base plate, and the abdomen massager covered with the medicated gauze is installed on the prone support. The sprocket bracket is fixedly installed on the base plate and is provided with the transmission shaft and the sprocket, the rotary plates are fixed on two ends of the transmission shaft, and the sprocket is configured to cooperate with the chain for transmission; the handwheel bracket is fixed on two sides of a front center of base plate, and is provided with the handwheels.

1 Claim, 1 Drawing Sheet

(51) Int. Cl.
*A61H 39/04* (2006.01)
*A61H 15/00* (2006.01)

(52) U.S. Cl.
CPC ..... *A61H 1/0237* (2013.01); *A61H 1/0274* (2013.01); *A61H 15/0085* (2013.01); *A61H 39/04* (2013.01); *A61H 2015/0007* (2013.01); *A61H 2201/0153* (2013.01); *A61H 2201/10* (2013.01); *A61H 2201/105* (2013.01); *A61H 2201/1269* (2013.01); *A61H 2203/0468* (2013.01); *A61H 2205/08* (2013.01); *A61H 2209/00* (2013.01)

(58) Field of Classification Search
CPC ..... A61H 1/0237; A61H 1/0274; A61H 2201/1269; A61H 2203/0468; A61H 2205/08; A61H 39/04; A61H 2201/0153; A61H 2201/10; A63B 22/0605; A63B 2208/0219
USPC ..... 601/94, 95; 482/55, 56
See application file for complete search history.

(56) References Cited

U.S. PATENT DOCUMENTS

| | | | | |
|---|---|---|---|---|
| 2,648,330 | A * | 8/1953 | O'Connor | A61H 1/0214 601/26 |
| 3,207,152 | A * | 9/1965 | Thornton | 601/86 |
| 5,897,473 | A | 4/1999 | Koenig | |
| 2008/0045910 | A1* | 2/2008 | Chau | A61H 15/0092 604/291 |
| 2010/0048367 | A1 | 2/2010 | Liang et al. | |
| 2010/0145398 | A1* | 6/2010 | Li | A61H 7/005 607/3 |
| 2013/0059921 | A1* | 3/2013 | Marrot | A61K 31/045 514/731 |
| 2013/0079200 | A1* | 3/2013 | Rahimi | A61H 1/0255 482/62 |

FOREIGN PATENT DOCUMENTS

| | | | |
|---|---|---|---|
| CN | 203750102 | U | 8/2014 |
| CN | 104207926 | A | 12/2014 |
| CN | 204092533 | U | 1/2015 |

* cited by examiner

HEPATOCARCINOMA METASTASIS THERAPY APPARATUS AND METHOD FOR USING THE SAME

CROSS-REFERENCE TO RELATED APPLICATIONS

This application is the U.S. National Stage of International Patent Application No. PCT/CN2015/088330, filed Aug. 28, 2015, which claims priority to Chinese Patent Application No. 201410524366.9, filed Oct. 8, 2014, both of which are incorporated herein in their entirety.

TECHNICAL FIELD

This application relates to a medical apparatus configured to treat hepatocarcinoma metastasis by combining medicinal massage, prone horizontal motion and surgery and chemoradiotherapy.

BACKGROUND

Human's body structure is designed for horizontal motion, while prone horizontal motion is the foundation for human beings to improve general functions so as to adapt to life existence, of which crawling exercises and swimming can help improve abdominal digestive functions, thus being conducive to treat metastasis of liver cancer and cancers related to gastrointestinal digestive systems. Patent ZL201320254913.7 has disclosed a lung cancer metastasis therapy apparatus on Dec. 25, 20013, which adopts supine horizontal motion but with little space for abdominal exercises due to the action of gravity. Thus, it is not beneficial to improve abdominal digestive functions or treat metastasis of liver cancer and cancers related to gastrointestinal digestive systems.

BRIEF SUMMARY OF THE APPLICATION

This application intends to recover body functions through holistic medicine massage, abdominal medicine massage, prone crawling exercises, and prone swimming by assembling the base plate, prone support, abdomen massager, sprocket drive, handwheels, and hand-held massager into an integral device aiming at insufficient function recovery of existing technologies in treating liver cancer metastasis that leads to systemic functional diseases or even death. This application adopts hand-held massagers and chemoradiotherapy in the cancerometastasis lesion stage to conduct the holistic therapy dominant by killing cancer cells and supplemented by recovering functions aiming to control metastatic lesion, alleviate symptoms and delay lesions. The existing technologies only carry out the palliative treatment without any function recoveries in the death stage of liver cancer metastasis. The body function lesion is the main cause of death, while the systemic cancer metastasis lesion is the secondary cause of death. Therefore, this application conducts the holistic treatment dominant by recovering body functions and supplemented by killing cancer cells aiming at regions with diseased abdominal digestive functions and decreased circulatory and respiratory functions so as to prevent global function lesion and reduce the mortality rate.

In order to achieve the above mentioned objectives, the technical proposal of this application was as follows: a hepatocarcinoma metastasis therapy apparatus, comprising a base plate, a prone support, an abdomen massager, a medicated gauze, a sprocket bracket, a transmission shaft, a sprocket, a chain, rotary plates, rotary plate bracket, pedals, a handwheel bracket, an adjustable speed motor and a hand-held massager, is used to treat hepatocarcinoma metastasis dominant by recovering body functions and supplemented by killing cancer cells together with chemoradiotherapy. The prone support is fixedly installed in the middle of the base plate. The abdomen massage covered with a medicated gauze is arranged on the prone support. The rotary plate bracket and the sprocket bracket are fixedly installed on a front and a rear of the base plate, respectively. The rotary plate bracket is provided with the transmission shaft, with the rotary plates being fixed at two ends of the transmission shaft. The sprocket is provided with the sprocket. The sprocket and the transmission shaft are in transmission connection via the chain. The handwheel brackets are fastened on two sides of a front center of the base plate and are provided thereon with the handwheels. The handwheels are configured to rotate in a plane in parallel with an upper surface of the base plate independent of the movement of the sprocket 6 and the transmission shaft. Patients can enjoy massage by lying on the abdomen massager with hands holding the rotary plates and feet fixed by pedals. Further, patients can conduct passive crawling exercises by starting the motor to revolve the chain on the sprocket bracket and the rotary plate bracket. Patients can also carry out active crawling exercises without using the motor and do some some minor swinging back and forth. More importantly, patients can continue with leg movement by loosening the rotary plates and holding the handwheels. After exercises, patients or doctors can conduct holistic medicine massage with hands holding the handheld massager to transport and replenish the mechanical energy, heat energy and chemical energy.

The apparatus according to this application is mainly used to recover digestive functions and treat decline in muscular movement, blood circulation, respiratory, immune and neurological functions etc, which can also be used to treat metastasis of liver cancer, esophagus cancer, gastric cancer as well as rectal cancer and colon cancer. Proper adjustments may be required aiming at different lesions and regions, but the principle and objective are consistent.

In the present application, the recovery function of the crawling movement is combined with the recovery of the heart and lung function of the swimming exercise, and the whole function of the body is restored by promoting the whole action to each other. If only one of the exercises is carried out, the whole function cannot be produced. For the whole body function, abdominal digestive function and chest heart and lung function is interdependent but as a whole, the lack of one part thereof will lose the overall function.

1. According to the present application, the transmission device for driving the front wheel in the prior art by the supine position pedal is changed to the tilting position pedal wheel to drive the front wheel drive device, thus becoming a human instinct to crawl action, suitable for the recovery of the whole body needs. In positions of the arm strokes are installed two handwheels, the rotation of two arms or small round swing of separate arms is combined with the back and forth movement of the legs, to form a swimming action, which is conducive to the recovery of body function. In the prone level exercise, the abdomen drug massage device is adopted to treat abdominal digestive function lesions, and the hand massage is adopted to take a drug massage to the body, so as to achieve the goal of recovery of systemic function.

2. The application is adapted for the user to perform two kinds of movements, including crawling and swimming in the horizontal movement, the crawling movement is the effect of the double arms and the legs being alternately with each other, which requires low strength, is suitable for each 10 minutes long movement, has a strong effect on abdominal visceral digestive function, and can promote the abdominal digestive organs to take shrink and relax "massage" exercise. Swimming movement is a pair of arms symmetrical ring rotation and legs side by side role, which requires high strength, is suitable for a short time movement, each 5 minutes, in the operation of the pedal bar through the fixed connection with the other side of the pedal to adjust to the same turn the direction, the user can carry forward the legs before and after the movement. Swimming movement in the aims of symmetrical circular rotation is the expansion of the chest movement, which can squeeze and relax the heart and the lungs, improve heart activity and chest breathing, can improve heart and lung function. During crawling and swimming movement, the leg action force is greater, the user can add speed motor to help, and the arm action force is too small to help.

3. A hand-held massager is used to massage the whole body, and a hand-held massager is a "cancer treatment device" (National Application Patent ZL200610069987.8, Japanese Patent Laid-Open No. 5047301) of the prior art. Hand-held massager are equipped with a DC cut into the friction head, low frequency static friction head, magnetic friction head, friction cloth, with friction heat, according to rub muscle, transdermal drug, electrotherapy, magnetic therapy, with effect in the local area within 8 seconds, 8 minutes to complete the body drug massage, suitable for treatment in all parts of the body, through the delivery of heat, mechanical energy, energy, magnetic energy and chemical energy to restore functional treatment. Hand-held massager in the friction head rotating high speed of 2000 r/min, low speed of 500 r/min; friction head pressure at 0.25 kg-0.5 kg/square meter is suitable for friction and heat, transdermal drug, acupuncture treatment, at 0.5 kg-2 kg/square meter it is suitable for the kneading muscles, soft tissue, the force at 3 kg-5 kg/cm can reach the depth of tissue and bone surface; high-speed rotation within 5 seconds can heat the skin to 50° C.-60° C.

4. Treatment work principle and characteristics.

In the stage of cancer metastasis, the killing of cancer cells is the main treatment of the existing chemotherapy technology, the recovery function-based therapy uses hand-held massager and surgery combined with radiotherapy and chemotherapy. Before radiotherapy, it is necessary to take recovery-based function therapy to the radiotherapy site firstly, each for 1-2 minutes, and then radiotherapy. In the interventional chemotherapy, firstly take the interventional chemotherapy, after the end of interventional chemotherapy, use hand-held massager at the intervention site (such as drugs when the tumor is aimed at the tumor) to restore functional treatment for 1-2 minutes each time. In systemic chemotherapy, the user can take the whole body massage after the end of chemotherapy with a hand-held massager to restore the recovery function, each for 5 minutes, the user can also use traditional Chinese medicine to supplement the energy of the body massage, the same is 5 minutes each time. If the user do not carry out auxiliary recovery-based function therapy, killing cancer-based treatment cannot be sustained due to lack of symmetry stability of side effects, and only transient treatment can be carried out, but not the long-term treatment. In the cancer metastasis of patients with death stage, combine the restoration of human body function-based treatment with the radiotherapy and chemotherapy to kill cancer cells. Compared with the eradication of cancer-based treatment, the eradication of cancer cell adjuvant therapy should significantly reduce the killing of cancer cells, the scope of action and increase the mode of action, such as low-dose chemotherapy, interventional chemotherapy, anti-Medicine, etc., plays a role to stabilize and prevent the metastatic lesions of cancer from recurring. Similarly, if not take killing cancer cells adjuvant therapy, the body's main recovery function will limited by cancer cells and cannot effect for a long time due to lack of symmetry stability, and ultimately lead to treatment failure.

Advantages of the liver cancer metastasis therapeutic device are summarized as follows:

1. In the treatment of cancer metastasis, structural treatment is interdependence with functional treatment and makes effects together, in line with the laws of nature, suitable for rehabilitation of patients survived. In the prior art, structural treatment and functional therapy are separated from each other, and their respective effects can only produce a certain number of changes, but fail to produce the overall nature of change, thereby failing to meet the laws of nature and ultimately leading to death of the patient.

2. The prior art in the stage of cancer metastasis lesions, use surgical chemotherapy to kill cancer-based treatment as the main treatment, however, in the stage of death of cancer patients, the systemic functional lesions have become the main factors of death, the existing treatment is still the same, which does not take the recovery-based function therapy as the main treatment. The present application overcomes this deficiency by using a recovery-based function therapy in the stage of death of cancer metastasis patients.

3. Crawing movements and swimming movements in the supine horizontal exercise are instinct movements for human survival, in line with human structural design requirements, and are the basis to save the lives of patients. The existing medical sports crawling and swimming, featuring long time exercise, high consumption of physical strength, low efficiency, time-consuming, and slow laborious effect, cannot meet the needs of patients in the critical stage of treatment. The device according to the present application is quick and effective in 8 minutes to complete the recovery of systemic functional treatment, which significantly improves the effect and meet the treatment needs.

4. The existing technology supine horizontal exercise cannot produce direct treatment of abdominal digestive function by the drug massage on the back; and may have side effects on the abdominal digestive organs of cancer metastasis tissue by the drug massage above the abdomen, so cannot be applied. In the prone level movement, the medicament massage is carried out under the abdomen, not only does the abdomen drug massage reduce the pressing side effect due to the relaxation of the abdominal viscera and the internal massage, but also the combination of the internal and external massage improves the therapeutic effect remarkably.

DETAILED DESCRIPTION OF THE PREFERRED EMBODIMENT

Figure 1:
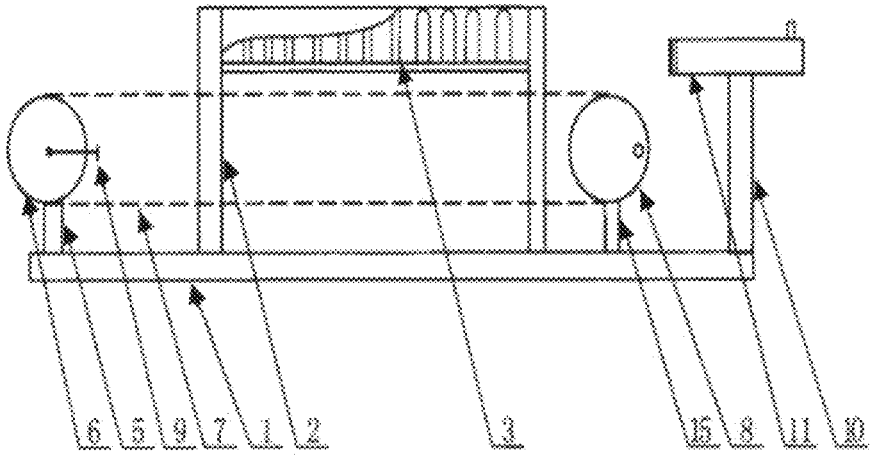
FIG. 1 illustrates a front view of a liver cancer metastasis therapeutic device according to the present application.
Figure 2:
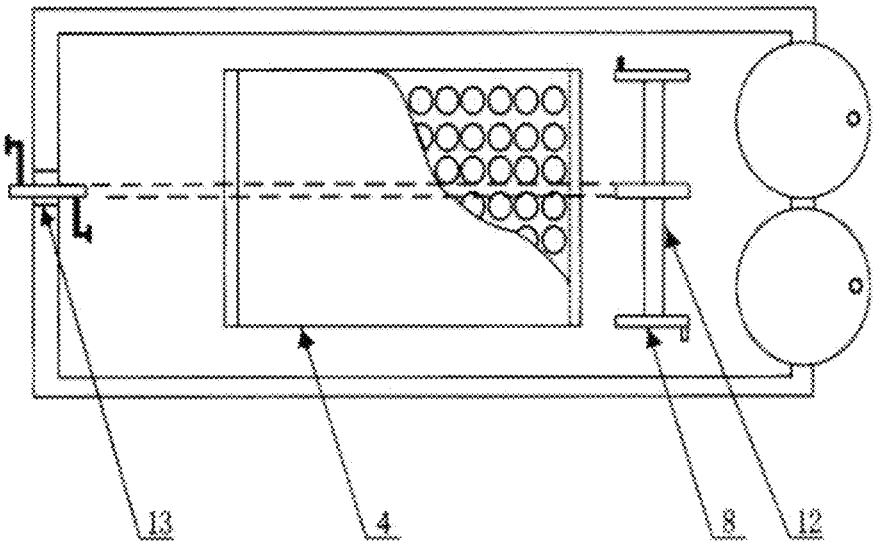
FIG. 2 illustrates a top view of the applicator shown in FIG. 1.

FIG. 1 shows a liver cancer metastasis therapeutic device, in which, 1 is a base plate; 2 is a prone support; 3 is an abdomen massager; 5 is a sprocket bracket; 6 is a sprocket; 7 is a chain, 8 is a rotary plate; 15 is a rotary plate bracket, 9 is a pedal, 10 is a handwheel bracket, and 11 is a handwheel. FIG. 2 shows a liver metastases therapeutic device, in which 4 is a medicated gauze; 8 is a rotary plate; 12 is a transmission shaft; 13 is an adjustable speed motor. 14 in FIG. 3 is a hand-held mas sager.

The present application is achieved by the following technical measures: a liver cancer metastasis therapeutic device comprising a base plate 1, a prone support 2, a abdomen massager 3, a medicated gauze 4, a sprocket bracket 5, a transmission shaft 12, a sprocket 6, a chain 7, rotary plates 8, a rotary plate bracket 15, pedals 9, a handwheel bracket 10, handwheels 11, an adjustable speed motor 13, a hand-held massager device, to restore the body's body-based treatment, combined with chemotherapy and chemotherapy to kill cancer cells combined treatment of liver cancer metastasis. The prone support 2 is fixedly mounted in the middle of the base plate 1, the abdomen massager 3 covered with the medicated gauze 4 is arranged on the prone support 2. The rotary plate bracket 15 and the sprocket bracket 5 are fixedly installed on a front and a rear of the base plate 1, respectively. The rotary plate bracket 15 is provided with the transmission shaft 12, with the rotary plates 8 being fixed at two ends of the transmission shaft 12. The sprocket bracket 5 is provided with the sprocket 6; and the sprocket 6 and the transmission shaft 12 are in transmission connection via the chain 7. The handwheel brackets 10 are fixed on two sides of a front center of the base plate 1, and are provided with the handwheels 11. The handwheels are configured to rotate in a plane in parallel with an upper surface of the base plate independent of the movement of the sprocket 6 and the transmission shaft 12. The patient can lie prone on the abdomen massager 3 and the abdomen massager can be turned on to perform medicine massage with a desired medicine, the patient holding the rotating lever 8, the feet are fixed by the pedals 9, and the adjustable speed motor 13 is started to rotate the chain 7, so that the passive crawling movement can be carried out. when the motor is turned off, active crawling movement can be carried out. When the user releases his hands from the grip plate 8 and holds the handwheel 11 hand to rotate, he can do swim-like sports. After exercise, use hand massage 14 by the patient or the doctor for systemic drug massage, supplement the transport of mechanical energy, heat, chemical energy.

Treatment specific steps are as follows:

According to the different stages of liver cancer metastasis, firstly use hand-held massager and radiotherapy combined with surgery as a whole, take a recovery-based function treatment supplemented by the overall treatment to kill cancer in the liver metastases and around the site. Stabilize and control the transfer of lesions, in the stage of death of liver cancer metastasis, use prone level movement, abdomen massage and hand massage into a whole, take a recovery-based function treatment supplemented by the overall treatment on the digestive function of the lesion and related circulation, respiratory, immune, neurological and other functional decline in the body to prevent the emergence of systemic functional lesions and prevent death.

1. Recovery function combined with radiotherapy 5 minutes before the prior art radiotherapy, in the primary lesion, the radiotherapy site of the metastatic lesion is coated with external medicine for promoting blood circulation and removing blood stasis, and the massage therapy is performed for 1-2 minutes with a hand-held massager and then radiotherapy is performed. 3-5 minutes after the end of radiotherapy, the topical drug for strengthening spleen and invigorating qi are applied at the radiotherapy center around the functional decline parts, hand-held massager is used to restore the function for 1-2 minutes of drug massage therapy.

2. Recovery function combined with local chemotherapy.

After the treatment of the catheter hydrazine arterial chemoembolization (TACE), the topical drug is applied for promoting circulation and removing stasis in the treatment of lesions site, the handheld massage is used for 1-2 minutes, improving microcirculation of the lesion, and promoting drug absorption, and then the topical drug for strengthening spleen and invigorating qi is applied to the treatment of parts of the lesion around the larger area, the handheld massage is used for 1-2 minutes of drug massage, to restore the purpose of the function. For the transfer of lesions, the injection within tumor can be used, and the recovery function is same with the above method.

3. Recovery function combined with systemic chemotherapy.

Within 5 minutes after the end of systemic chemotherapy, patients can be applied with topical drug for strengthening spleen and invigorating qi, promoting circulation and removing stasis and detoxification on the chest and abdomen, waist and limbs, (drug selection varies from person to person) and use the hand-held massager to carry out systemic drug massage, each treatment for 8 minutes, take a restore functional treatment for the elimination of chemotherapy side effects.

Whether or not the transfer of lesions is to eliminate the control, the condition is aggravated or reduced, cancer metastasis patients sooner or later will enter the stage of death of liver cancer metastasis, directly face the death of the body function of this death factor. Because at this time the structure of metastatic lesions is in a relatively stable stage, where the systemic functional disease develops, the recovery-based function therapy supplemented by the treatment of killing cancer cells is necessitated to restore the body function, and a large treatment device that enhances systemic function is required.

4. Recovery function treatment of liver cirrhosis, liver ascites and digestive function, circulation, respiratory.

The use of traditional Chinese medicine outside the treatment of liquid with strengthening spleen and invigorating qi, good for liver and kidney, cirrhosis of the cream, water paste, blood circulation, detoxification, western medicine, nitroglycerin, heartache and so on. liquid is applied to the treatment area and use hand-held massager for reciprocating massage. Treatment is performed once a day, each time 1-3 minutes, 15 times for a course of treatment.

5. Recovery function is combined with chemotherapy

The use of prone level movement in the crawling action, swimming movements, abdomen massage and body massage to restore the body function-based treatment, each time a total of 10 minutes, once every other day, while every other day injection of fluorouracil 250 mg, or small dose injection of molecular targeting anticancer drugs. Treatment sequence is the end of chemotherapy after the recovery of functional treatment, the treatment can be long-term.

6. Recovery function combined with drug injection, transdermal administration.

Use aconite injection, polyporus umbellatus polysaccharide, hedyotisdiffusa, methotrexate (MTX) and other points of anti-cancer drug injection, once a day, injection dose, refer to the instructions. In the transfer site, use fluorouracil topical liquid for transdermal drug delivery and massage treatment, once a day, each for 1-3 minutes, 15 days for a course of treatment, liquid composition, refer to the instructions. The adjuvant therapy of killing cancer cells, reduce the intensity of radiotherapy and chemotherapy, increase the number of treatment and treatment, according to the patient recovery function can be taken for long-term.

During the treatment according to the patient's condition, physical and human differences determine the dose used, the level of movement and massage the intensity. During the course of treatment and after treatment, the double test of structure and function was carried out. The structural examination was based on the existing technical standard. The functional test was based on the recovery function and the quality of life.

Embodiments of the Present Application

Crawling and swimming is a medical sport with a recovery function, and many cancer patients have a healing effect by using such medical sports. The application adopts the prone level movement device, combines the crawling, swimming medical sports with the abdomen massage, the hand massage and body massage, through the overall role of the body to restore the body function, can significantly improve the existing technology medical sports, massage therapy force to meet the recovery function and rehabilitation needs of cancer patients.

The invention claimed is:

1. A liver cancer metastasis therapeutic device, comprising: a base plate (1), a prone support (2), an abdomen massager (3), a medicated gauze (4), a sprocket bracket (5), a transmission shaft (12), a sprocket (6), a chain (7), rotary plates (8), a rotary plate bracket (15), pedals (9), handwheel brackets (10), handwheels (11), and an adjustable speed motor (13);

wherein the prone support (2) is fixedly installed on a middle of the base plate (1), and the abdomen massager (3) covered with the medicated gauze (4) is installed on the prone support (2);

the rotary plate bracket (15) and the sprocket bracket (5) are fixedly installed on a front and a rear of the base plate (1), respectively;

the rotary plate bracket (15) is provided with the transmission shaft (12), with the rotary plates (8) being fixed on two ends of the transmission shaft (12); the sprocket bracket (5) is provided with the sprocket (6);

the sprocket (6) and the transmission shaft (12) are in transmission connection via the chain (7); and the handwheel brackets (10) are fixed on two sides of a front center of the base plate (1), and are provided with the handwheels (11), respectively; and the handwheels are configured to rotate in a plane in parallel with an upper surface of the base plate, and rotations of the handwheels are independent of movements of the sprocket (6) and the transmission shaft (12).

* * * * *